US012460525B2

(12) United States Patent
Alruwaili et al.

(10) Patent No.: US 12,460,525 B2
(45) Date of Patent: Nov. 4, 2025

(54) HYBRID FRAC COMPLETION

(71) Applicant: SAUDI ARABIAN OIL COMPANY, Dhahran (SA)

(72) Inventors: Khalid Mohammed Alruwaili, Dammam (SA); Murtadha J. Altammar, Dhahran (SA); Ayman Mohammed Almohsin, Dhahran (SA); Waheed Syed Arshad, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 111 days.

(21) Appl. No.: 18/489,646

(22) Filed: Oct. 18, 2023

(65) Prior Publication Data

US 2025/0129698 A1 Apr. 24, 2025

(51) Int. Cl.
*E21B 43/26* (2006.01)
*E21B 33/12* (2006.01)
(Continued)

(52) U.S. Cl.
CPC ..... *E21B 43/261* (2013.01); *E21B 33/1208* (2013.01); *E21B 34/066* (2013.01);
(Continued)

(58) Field of Classification Search
CPC .. E21B 43/261; E21B 33/1208; E21B 43/116; E21B 43/14; E21B 34/14; E21B 43/26
See application file for complete search history.

(56) References Cited

U.S. PATENT DOCUMENTS 7,743,825 B2 6/2010 O'Malley et al.
8,104,538 B2 1/2012 Richard et al.
(Continued)

FOREIGN PATENT DOCUMENTS

CN 204082105 U 1/2015
CN 104681915 B 3/2018
(Continued)

OTHER PUBLICATIONS

International Search Report and Written Opinion issued in corresponding International Application No. PCT/US2024/051012, dated Dec. 19, 2024 (13 pages).
(Continued)

*Primary Examiner* — Catherine Loikith
(74) *Attorney, Agent, or Firm* — Osha Bergman Watanabe & Burton LLP

(57) ABSTRACT

Methods and systems for hybrid frac completion include installing a hybrid completion system in a well and, in each zone of a first plurality of zones for plug & perf completion: activating an outer shroud of expanding shape memory polymer (SMP) around a liner, and perforating, using a perforation gun, a borehole wall. The methods further include, in each zone of the second plurality of zones for sliding sleeve completion: activating an SMP packer, and activating a sliding sleeve to expose the borehole wall. The methods further include fracturing the borehole wall by pressurizing the well; sealing, between each zone in the first and second plurality of zones, by actuating a plurality of isolation valves disposed in each zone of the first plurality of zones and each zone of the second plurality of zones; and removing the plurality of isolation valves to produce the well.

16 Claims, 5 Drawing Sheets

(51) Int. Cl.

| | |
|---|---|
| ***E21B 34/06*** | (2006.01) |
| ***E21B 34/14*** | (2006.01) |
| ***E21B 43/116*** | (2006.01) |
| ***E21B 43/14*** | (2006.01) |

(52) U.S. Cl.
CPC ..... *E21B 34/142* (2020.05); *E21B 43/116* (2013.01); *E21B 43/14* (2013.01)

(56) References Cited

U.S. PATENT DOCUMENTS

| | | | | |
|---|---|---|---|---|
| 8,763,687 | B2 | 7/2014 | Ingram et al. | |
| 9,222,333 | B2 | 12/2015 | Hoffman et al. | |
| 9,670,750 | B2 * | 6/2017 | Chauffe | E21B 34/14 |
| 10,053,968 | B2 | 8/2018 | Tolman et al. | |
| 10,119,377 | B2 | 11/2018 | Snider | |
| 10,704,383 | B2 * | 7/2020 | Andreychuk | E21B 43/26 |
| 11,085,278 | B2 | 8/2021 | Akkerman et al. | |
| 11,319,772 | B2 | 5/2022 | Walton et al. | |
| 2010/0089587 | A1 | 4/2010 | Stout | |
| 2010/0282469 | A1 | 11/2010 | Richard et al. | |
| 2013/0014953 | A1 | 1/2013 | van Petegem | |
| 2017/0044880 | A1 | 2/2017 | Yeh et al. | |
| 2019/0112517 | A1 | 4/2019 | Dahi Taleghani et al. | |
| 2020/0362693 | A1 | 11/2020 | Ahmadian-Tehrani | |

FOREIGN PATENT DOCUMENTS

| | | | |
|---|---|---|---|
| CN | 108868726 | A | 11/2018 |
| CN | 110685611 | A | 1/2020 |
| EP | 3092367 | B1 | 5/2018 |

OTHER PUBLICATIONS

Z. Lichen et al., "Active Tag Control Sliding Sleeve Fracturing Technology", In SPE Asia Pacific Oil and Gas Conference and Exhibition, Oct. 2017, SPE-186407-MS, pp. 1-8 (8 pages).

Z. Lichen et al., "Controllable Sliding Sleeve Fracturing Technology", In SPE Asia Pacific Oil & Gas Conference and Exhibition, Oct. 2014, pp. 1-8 (8 pages).

M. Merron et al., "Electronic Sliding Sleeve for Unlimited Zone Multistage Completion System", In SPE Annual Technical Conference and Exhibition, Oct. 2017, SPE-187204-MS, pp. 1-10 (10 pages).

Z. Shicheng et al., "Effect of Nano-silica Modification on the Tensile Property of SMA/GF/CF/Epoxy Super Hybrid woven Fabric Composites", Journal of Wuhan University of Technology-Mater. Sci. Ed., 2017, vol. 32, No. 6, pp. 1293-1300 (8 pages).

C. Gragl, 2018. "Review of Recent Unconventional Completion Innovations and their Applicability to EGS Wells", Proceedings, 43rd workshop on geothermal reservoir engineering, Feb. 12-14, 2018, SGP-TR-213 (8 pages).

N. Zheng et al., "High strain epoxy shape memory polymer", Royal Society of Chemisty, Polymer Chemistry Accepted Manuscript, 2015, pp. 1-23 (24 pages).

M. S. Ahmed et al., "Limited-entry OHMS improves Saudi deep-gas production", Oil & Gas Jouornal, The Permian Khuff carbonate reservoir in the Ghawar structure of Saudi Arabia produces nonassociated gas and condensate, Jun. 2, 2014 (15 pages).

A. Almohsin et al., "Self-Healing PAM Composite Hydrogel for Water Shutoff at High Temperatures: Thermal and Rheological Investigations", Paper presented at the SPE Gas & Oil Technology Showcase and Conference, Dubai, UAE, Oct. 2019. doi: https://doi.org/10.2118/198664-MS, pp. 1-8 (8 pages).

* cited by examiner

HYBRID FRAC COMPLETION

BACKGROUND

Tight formations require stimulation by initiating and extending hydraulic fractures into the reservoir to increase well productivity. A single type of frac completion design is typically deployed to enable hydraulic fracturing in a subterranean formation. The completion design is selected based on the borehole conditions and production strategies. There are two predominant types of multi-stage frac completion designs that are utilized and deployed in fracturing operations: (1) the sliding-sleeve completion design for open-hole and (2) the "plug & perf" completion design for cased-hole. Based on rock type, borehole condition, stress analysis (collectively borehole profile), and the completion cost, a particular type of completion design is selected. In some cases, the borehole profile may justify the deployment of two different frac completion designs to enable maximum return from wells. Currently, the industry generally adapts a single completion design per well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments related to a method for hybrid frac completion are disclosed. The methods include installing a hybrid completion system in a well and, in each zone of a first plurality of zones for plug & perf completion: activating an outer shroud of expanding shape memory polymer (SMP) around a liner, and perforating, using a perforation gun, a borehole wall. The methods further include, in each zone of the second plurality of zones for sliding sleeve completion: activating an SMP packer, and activating a sliding sleeve to expose the borehole wall. The methods further include fracturing the borehole wall by pressurizing the well; sealing, between each zone in the first and second plurality of zones, by actuating a plurality of isolation valves disposed in each zone of the first plurality of zones and each zone of the second plurality of zones; and removing the plurality of isolation valves to produce the well.

In general, in one aspect, embodiments related to a system are disclosed. The system includes a hybrid completion system, configured to be installed in a well, wherein the hybrid completion system is divided into a first plurality of zones for plug & perf completion and a second plurality of zones for sliding sleeve completion; an outer shroud of expanding shape memory polymer (SMP), configured to be activated around a liner in each zone in the first plurality of zones for plug & perf completion; a perforation gun, configured to perforate a borehole wall; an SMP packer, configured to seal a borehole; a sliding sleeve, configured to expose the borehole wall; a drilling system, configured to fracture the borehole wall by pressurizing the well; a plurality of isolation valves, one in each zone of the first plurality of zones for plug & perf completion and the second plurality of zones for sliding sleeve completion, configured to seal each zone; and a drill bit, configured to remove the plurality of isolation valves and produce the well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
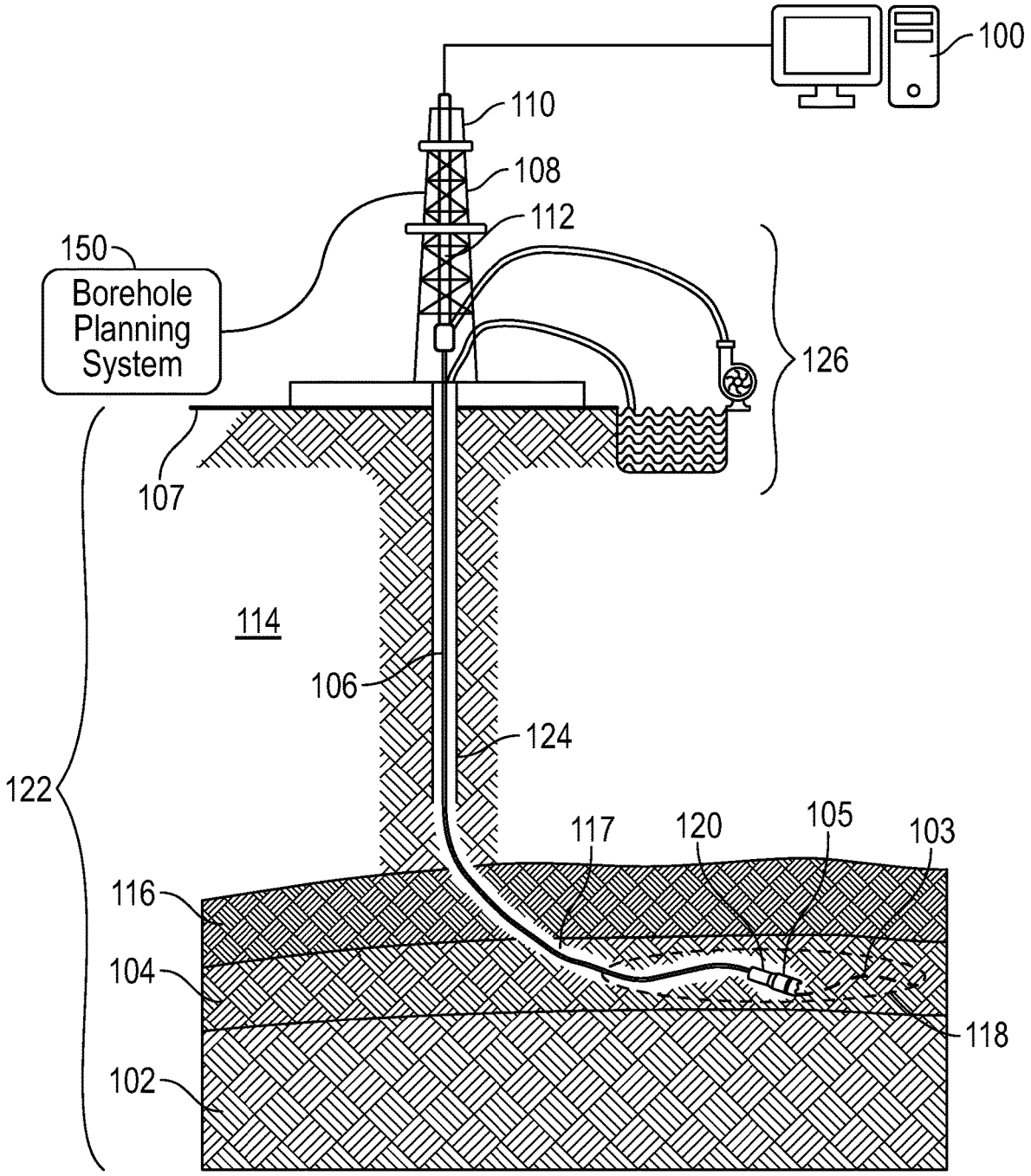
FIG. 1 shows a drilling system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-7, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a borehole" includes reference to one or more of such boreholes.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

What is presented below pertains to hydraulic fracturing. Tight formations require stimulation by initiating and extending hydraulic fractures into a reservoir to increase well productivity. A single type of frac completion design is typically deployed to enable hydraulic fracturing in a subterranean formation. The completion design is selected based on borehole conditions and production strategies. In this invention, system and methods are presented to combine sliding sleeve and plug & perf completion designs into a single hybrid completion design.

Before further presenting the proposed invention, the essential elements of a drilling system within a well are presented for context.

FIG. 1 shows a drilling system (100) in accordance with one or more embodiments. Although the drilling system (100) shown in FIG. 1 is used to drill a borehole on land, the drilling system (100) may also be a marine borehole drilling system. The example of the drilling system (100) shown in FIG. 1 is not meant to limit the present disclosure.

As shown in FIG. 1, a borehole path (103) may be drilled by a drill bit (105) attached by a drillstring (106) to a drill rig located on the surface (107) of the earth. The drill rig may include framework, such as a derrick (108), to hold drilling machinery. The top drive (110) sits at the top of the derrick (108) and provides torque, typically a clockwise torque, via the drive shaft (112) to the drillstring (106) in order to drill the borehole (117). The borehole (117) may traverse a plurality of overburden (114) layers and one or more cap-rock (116) layers to a hydrocarbon reservoir (104) within the subterranean region of interest (102). In accordance with one or more embodiments, an extended bandwidth seismic dataset may be used to plan a borehole (117) including a borehole path (103) and drill a borehole (117) guided by the borehole path (103). The borehole path (103) may be a curved borehole path, or a straight borehole path. All or part of the borehole path (103) may be vertical, and some borehole paths (103) may be deviated or have horizontal sections.

Prior to the commencement of drilling, a borehole plan may be generated. The borehole plan may include a starting surface location of the borehole (117), or a subsurface location within an existing borehole (117), from which the borehole (117) may be drilled. Further, the borehole plan may include a terminal location that may intersect with the target zone (118), e.g., a targeted hydrocarbon-bearing formation, and a planned borehole path (103) from the starting location to the terminal location. In other words, the borehole path (103) may intersect a previously located hydrocarbon reservoir (104).

Typically, the borehole plan is generated based on the best available information at the time of planning from a geophysical model, geomechanical models encapsulating subterranean stress conditions, the trajectory of any existing boreholes (117) (which one may desire to avoid), and the existence of other drilling hazards, such as shallow gas pockets, over-pressure zones, and active fault planes. In accordance with one or more embodiments, the borehole plan may be informed by an extended bandwidth seismic dataset acquired through a seismic survey conducted over the subterranean region of interest (102).

The borehole plan may include borehole geometry information such as borehole diameter and inclination angle. If casing (124) is used, the borehole plan may include casing type or casing depths. Furthermore, the borehole plan may consider other engineering constraints such as the maximum borehole curvature ("dog-log") that the drillstring (106) may tolerate and the maximum torque and drag values that the drilling system (100) may tolerate.

A borehole planning system (150) may be used to generate the borehole plan. The borehole planning system (150) may comprise one or more computer processors in communication with computer memory containing the geophysical and geomechanical models, the extended bandwidth seismic dataset, information relating to drilling hazards, and the constraints imposed by the limitations of the drillstring (106) and the drilling system (100). The borehole planning system (150) may further include dedicated software to determine the planned borehole path (103) and associated drilling parameters, such as the planned borehole diameter, the location of planned changes of the borehole diameter, the planned depths at which casing (124) will be inserted to support the borehole (117) and to prevent formation fluids entering the borehole (117), and the drilling mud weights (densities) and types that may be used during drilling the borehole (117).

A borehole (117) may be drilled using a drill rig that may be situated on a land drill site, an offshore platform, such as a jack-up rig, a semi-submersible, or a drill ship. The drill rig may be equipped with a hoisting system, such as a derrick (108), which can raise or lower the drillstring (106) and other tools required to drill the well. The drillstring (106) may include one or more drill pipes connected to form a conduit and a bottom hole assembly (BHA) (120) disposed at the distal end of the drillstring (106). The BHA (120) may include a drill bit (105) to cut into subsurface rock (122). The BHA (120) may further include measurement tools, such as a measurement-while-drilling (MWD) tool and logging-while-drilling (LWD) tool. MWD tools may include sensors and hardware to measure downhole drilling parameters, such as the azimuth and inclination of the drill bit (105), the weight-on-bit (WOB), and the torque. The LWD measurements may include sensors, such as resistivity, gamma ray, and neutron density sensors, to characterize the rock formation surrounding the borehole (117). Both MWD and LWD measurements may be transmitted to the surface (107) using any suitable telemetry system, such as mud-pulse or wired-drill pipe, known in the art.

To start drilling, or "spudding in" the well, the hoisting system lowers the drillstring (106) suspended from the derrick (108) towards the planned surface location of the borehole (117). An engine, such as a diesel engine, may be used to supply power to the top drive (110) to rotate the drillstring (106). The weight of the drillstring (106) combined with the rotational motion enables the drill bit (105) to drill the borehole (117).

The near surface is typically made up of loose or soft sediment or rock, so large diameter casing (124), e.g., "base pipe" or "conductor casing," is often put in place while drilling to stabilize and isolate the borehole (117). At the top of the base pipe is the wellhead, which serves to provide pressure control through a series of spools, valves, or adapters. Once near-surface drilling has begun, water or drill fluid may be used to force the base pipe into place using a pumping system until the wellhead is situated just above the surface (107) of the earth.

Drilling may continue without any casing (124) once deeper, or more compact rock is reached. While drilling, a drilling mud system (126) may pump drilling mud from a mud tank on the surface (107) through the drill pipe. Drilling mud serves various purposes, including pressure equalization, removal of rock cuttings, and drill bit cooling and lubrication.

At planned depth intervals, drilling may be paused and the drillstring (106) withdrawn from the borehole (117). Sections of casing (124) may be connected and inserted and cemented into the borehole (117). Casing string may be cemented in place by pumping cement and mud, separated by a "cementing plug," from the surface (107) through the drill pipe. The cementing plug and drilling mud force the cement through the drill pipe and into the annular space between the casing (124) and the borehole wall. Once the cement cures, drilling may recommence. The drilling process is often performed in several stages. Therefore, the drilling and casing cycle may be repeated more than once, depending on the depth of the borehole (117) and the pressure on the borehole walls from surrounding rock.

Furthermore, during an interval when drilling is paused and the drillstring (106) is removed, wireline may be lowered with sensors to take measurements of the borehole formations.

Due to the high pressures experienced by deep boreholes (117), a blowout preventer (BOP) may be installed at the wellhead to protect the rig and environment from unplanned oil or gas releases. As the borehole (117) becomes deeper, both successively smaller drill bits (105) and casing string may be used. Drilling deviated or horizontal boreholes (117) may require specialized drill bits or drill assemblies.

A drilling system (100) may be disposed at and communicate with other systems in the well environment. The drilling system (100) may control at least a portion of a drilling operation by providing controls to various components of the drilling operation. In one or more embodiments, the drilling system (100) may receive data from one or more sensors arranged to measure controllable parameters of the drilling operation. As a non-limiting example, sensors may be arranged to measure WOB, drill RPM, flow rate of the mud pumps (GPM), and ROP of the drilling operation. Each sensor may be positioned or configured to measure a desired physical stimulus. Drilling may be considered complete when a target zone (118) is reached, or the presence of hydrocarbons is established.

Some wells may be drilled for the purposes of hydraulic fracturing (fracing). Fracing is a method for stimulating the flow of gas from hydrocarbon-bearing formations when the permeability of the geological formations in the hydrocarbon reservoir (104) is low. For fracing, fluids are pumped into a well at a high pressure, which causes fractures to open. The fractures extend away from the borehole wall, guided by the local stress field. A material known as proppant (e.g., grains of sand) may be mixed with the fluid pumped into the borehole (117) or, instead of proppant, acid can be pumped into a borehole (117) during fracing to create fractures and keep them open during pressurization. Ideally, fracing creates a high-permeability network of fractures extending away from the borehole wall, thus bypassing damaged areas of a formation in the borehole (117) and maximizing the surface area from which gas may enter into the borehole (117).

Tight (i.e., low permeability) geologic formations may require additional stimulation to initiate and extend hydraulic fractures into the hydrocarbon reservoir (104) and increase well productivity. There are two predominant types of multi-stage frac completion designs that are utilized and deployed for stimulation in tight formations. The first is the open-hole multi-stage fracturing method (also known as the "sliding sleeve"). This is used in open (i.e., un-cased) boreholes. The second design is the "plug & perf" completion design used in cased boreholes. In a given well, a single type of fracing completion design is typically deployed to enable hydraulic fracturing in a subterranean formation. The completion design is selected based on borehole conditions and production strategies. Uncased boreholes will typically use the sliding sleeve design, whereas cased boreholes will typically use the plug & perf design.

With the sliding sleeve completion design, a production liner is run with fracturing sleeves and openhole packers in a borehole (117) with no cement around the liner. The openhole packers help compartmentalize the borehole (117) into pay zones of interest, while the fracturing sleeves serve as points of access to formations for fracture initiation within the compartments. The fracturing sleeves are selectively placed across zones of interest, and each zone of interest is compartmentalized with the openhole packers. The sliding sleeve system allows access to multiple fracture points within an open borehole, and a unique ball activation feature enables sleeves to be actuated without intervention from the surface (107). The ball activation feature functions by dropping a ball from the surface (107) into a well, pumping it down to the first sleeve in the lower completion, which is in the deepest part of the borehole (117). The ball lodges in the seat of the sleeve and, by applying pressure, the sleeve is moved and a frac port is exposed that provides a connection between the inside of the liner and the borehole (117) annular section. This pathway allows for a specific zone to be hydraulically fractured. At the conclusion of the first stage of fracturing a second ball is dropped which lands in a second sleeve, up hole from the deepest part of the well. By pressurizing the borehole (117), the ball moves the fracturing sleeve and again exposes uncased borehole (117). This same ball also provides internal isolation between the first stage and the second stage. The ball dropping and fracturing cycle is repeated until all the stages are fractured in sequence. The well then is opened for flowback and the balls that were sitting in their respective seats are flowed back during production (or, depending on their metallurgy, they may dissolve in place).

Performing a sliding sleeve completion in an uncased borehole offers some advantages. For example, an openhole completion may allow natural fractures, if present in the formation, to contribute to production. Furthermore, the operation time associated with sliding sleeve fracing is normally shorter than plug & perf operations and therefore the operational costs are lower. This can save considerable time and money for an operator. The sliding sleeve completion also has drawbacks. For instance, an openhole completion requires that the borehole diameter (the gauge) is not too large. In this case of a large gauge, the placement of openhole packers may be challenging due to the expansion limit of an openhole packer. It may be required that the borehole (117) will need to be cased-off with a cemented liner and completed using a plug & perf design. Another drawback of the sliding sleeve design is that the number of frac stages may be limited due to the fixed amount of selective sleeves and seats available for a certain liner size.

For the plug & perf completion design an operator perforates a zone of interest in a cased hole in the deepest part of a horizontal well. The operator then hydraulically fractures the zone, isolates the zone with a bridge plug, and then perforates the next zone uphole, followed by further fracturing and isolating. This fracturing cycle is repeated based on the number of zones that are needed to be stimulated. The process of perforating each zone and then fracturing and isolating it with a bridge plug in sequence is called the "plug & perf" process. At the end of the process the bridge plugs that were set for zonal isolation between the fractured zones are drilled out with a drill bit (105), thus opening all zones for flow to the surface (107) and production. Alternatively, depending on their metallurgy, the plugs may dissolve in place to open the zones for production.

The plug & perf design offers some other advantages over the sliding sleeve design. Since the well is cemented with a liner, the gauge of the borehole (117) is no longer an impediment when using the plug & perf design for completion. Furthermore, a cemented liner provides the ability to have an unlimited amount of plug & perf frac stages, thus increasing the number of fracture entries available. Also, the cemented liner completion cost is generally lower than a sliding sleeve completion because it uses no specially-designed part (although operational costs are lower for the sliding sleeve design).

One drawback with a cemented liner, however, is that it creates additional barriers between a borehole (117) and producing formations. These barriers may cause formation breakdown issues during fracturing and introduce damage to the formation that may affect well productivity. Another drawback with a plug & perf completion is that any natural fractures present in the formation may be cemented up, leading to lost production.

Based on the rock type, the borehole conditions, and the stress analysis (collectively, the borehole profile), along with the completion cost, a particular type of completion design may be selected. For example, if operational costs are more important, the sliding sleeve design may be preferred. If completion costs are paramount, the plug & perf design may be preferred. If the borehole diameter is large, only the plug & perf design is appropriate. Furthermore, the equipment used in a sliding sleeve completion may not be rated to the borehole stress and pressure conditions, also leading to the necessity of the plug & perf design. Conversely, natural fractures in the borehole (117) may be cemented up in a plug & perf completion, so a sliding sleeve design may be chosen in order to keep the fractures open and exposed. Finally, the number of stages that may be fracced may be limited to the number of ball sizes used to open the sliding sleeves in a convention sliding sleeve design, hence favoring the use of the plug & perf design.

Currently, the prevalent frac completion technology typically allows for a single design in a single borehole (117) (i.e., sliding sleeve or plug & perf), although in some cases both frac completion designs may be applied in the same well. When combined, the setup will usually have a sliding sleeve system at the lower end of the completion and the cemented portion in the upper end of the completion for plug & perf. For the sliding sleeve completion design to work, the dropped balls must catch in a seat which, when the well is pressurized, will open the sleeve. The size of the balls increase up hole to fit the seats in different sliding sleeve sections. The smallest ball is dropped first and the largest for the last stage. However, there are a limited number of sizes that the seats and balls can fit into for a sliding sleeve completion. Therefore, to increase the number of stages, at least a few plug & perf zones are needed in a combined completion design; no balls or seats are required for the plug & perf completion design and the liner has no internal diameter restrictions. Therefore, in a combined completion design, the upper part of the string where there are no seats will typically use bridge plugs to separate and seal different zones (along with cement on the outside of the pipe in the borehole annulus).

A hybrid frac completion design is presented here that combines the sliding sleeve and a plug & perf completion methods in a novel way, thereby enabling enhanced well productivity and return on investment. The hybrid frac divides the completion system in a single borehole (117) into plug & perf and sliding sleeve zones with the option to put either design at any depth. The deployment of the system requires multiple components that can be installed in single run and provides a flexible distribution of stages based on the borehole conditions and the reservoir quality. For instance, if a zone in the borehole (117) at a shallow depth has a large diameter or the borehole formations are unstable, that zone may be cased and fractured with a plug & perf system. Conversely, if the borehole formations in a deeper section are stable and the borehole (117) has a smaller diameter, the sliding sleeve system may be installed there.

Figure 2:
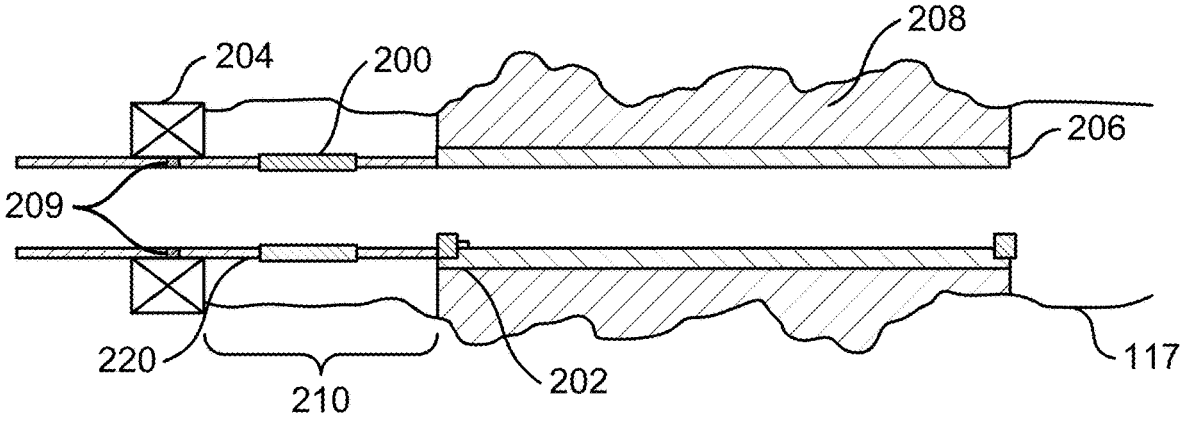
FIG. 2 shows a sliding sleeve and a liner in a hybrid completion system in accordance with one or more embodiments.

FIG. 2 shows the novel hybrid frac completion design. It may have four components: an Radio Frequency Identification (RFID)-operated sliding sleeve (200), an RFID-operated isolation valve (202), Shape Memory Polymer (SMP) packers (204), and special liner sections (206) with an outer shroud of expanding SMP (208). These components may be run on a standard liner (or casing (124)) into an openhole section (210) by a rig as for a standard completion design. Once the hybrid completion is installed, the outer shroud of expanding SMP (208) may be activated by a triggering agent to expand and create a seal between the outer diameter of the special liner section (206) and the borehole (117). A pipe section (220) with the sliding sleeve may have SMP packers (204) to enable zonal isolation in the openhole section (210) of the borehole (117). The sliding sleeve and the isolation valve (202) may be operated by RFID tags (402) pumped down into the well.

Figure 3:
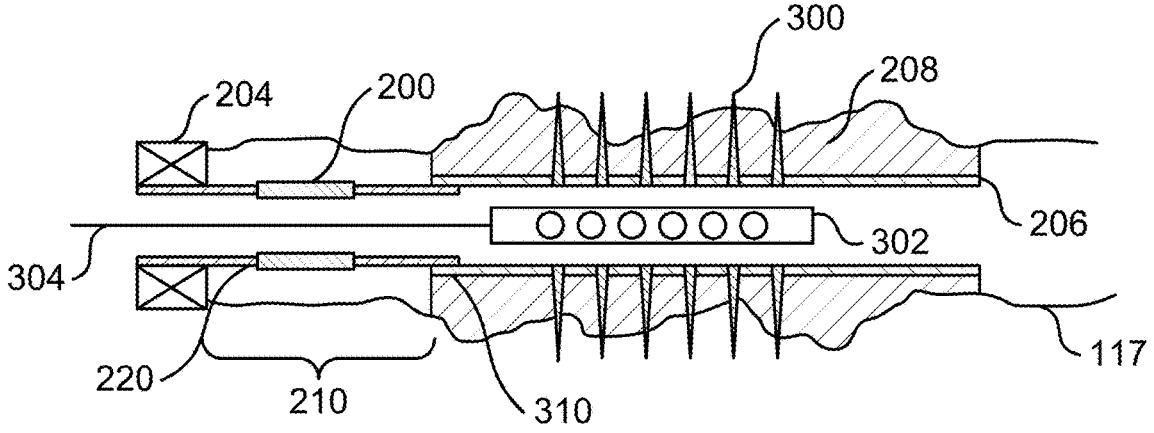
FIG. 3 shows the perforation of a liner in a hybrid completion system in accordance with one or more embodiments.

As shown in FIG. 3, the special liner section (206) and the SMP (208) are perforated with perforation tunnels (300) extending from a perforation gun (302) to create perforation fractures, and fracing is conducted with pressurized fluid and proppant. The perforation gun may be lowered into the well using wireline (304). A liner-pipe connection (310) connects the special liner section (206) with the pipe section (220).

Figure 4:
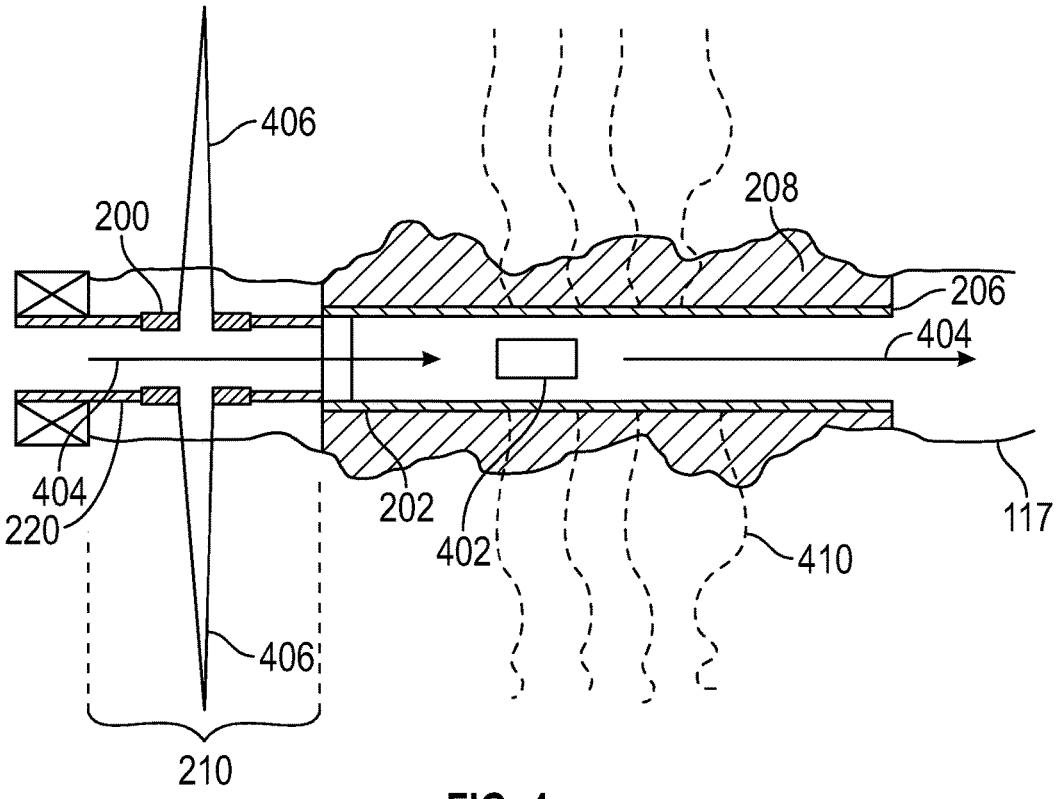
FIG. 4 shows the fracturing of a formation in an open hole in a hybrid completion system in accordance with one or more embodiments.

In FIG. 4, an RFID tag (402) is pumped down into the well with fluid (404) to activate the isolation valve (202). (The isolation valve (202) replaces the frac plug used in a typical plug & perf operations.) For the section of the well uphole of the isolation valve (202), the sliding sleeve (200) may be opened by pumping down another RFID tag (402). Once the sliding sleeve (200) has been opened, the openhole section (210) may be fracced creating openhole fractures (406). The operational process is repeated until all isolated sections are fractured. At the end of operation, the isolation valves (202) are drilled or dissolved for flowback and production.

During fracturing in either the sliding sleeve section or plug & perf section of the hybrid frac completion system, a frac fluid is pumped into the well and pressurized to initiate and propagate the hydraulic fractures.

The SMPs (208) are polymeric smart materials. A smart material, or memory material, is a material that remembers its original shape such that that after deformation it returns to its pre-deformed shape when its temperature is changed. The shape change of smart material may also be triggered by an electric or magnetic field or solution. The shape memory effect can be used to generate motion and/or force, while the elastic properties of smart materials allow for energy storage. The smart material used to construct the SMPs (208) may be an epoxy resin, alkali metal, or other similar material.

For the hybrid completion design described above, the SMP (208) material may be wrapped on the outer side of the liner section (206) and pipes. The SMP (208) may then be activated by a thermal or electric effect, or else with a solution to expand and create a firm connection to the borehole wall. Similarly, the SMP (208) material may be used as sealing packers for the sliding sleeve section to enable zonal isolation (see, e.g., FIG. 4).

Figure 5:
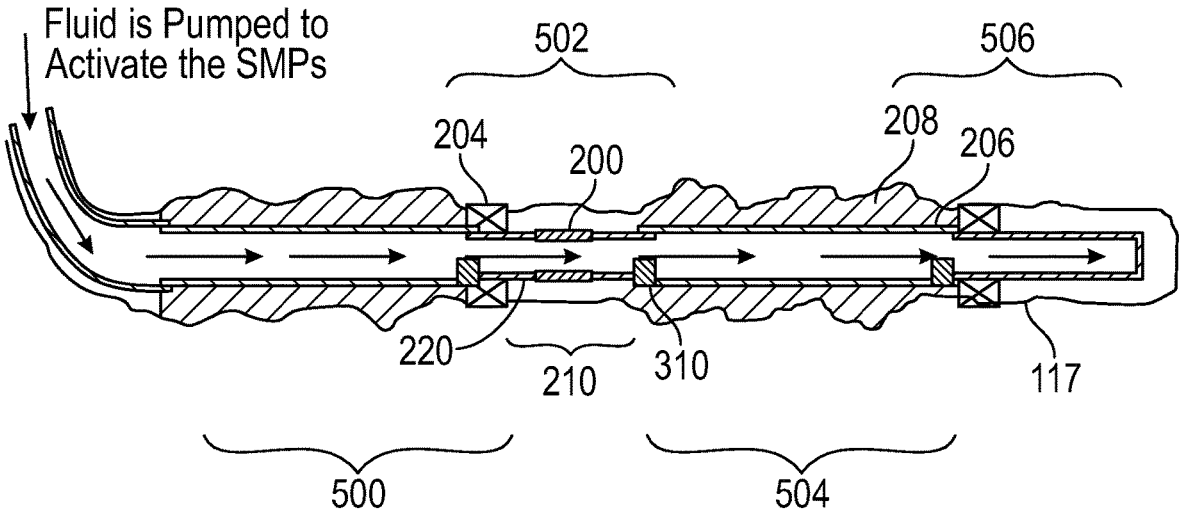
FIG. 5 shows the hybrid completion system in accordance with one or more embodiments.

FIG. 5 shows an example of a hybrid completion design with two sliding sleeve zones (the second zone (502) and the fourth zone (506) as numbered descending from the surface (107)) and two plug & perf zones (the first zone (500) and third zone (504) as numbered descending from the surface (107)). Typical operation of the hybrid completion design would involve activating the SMP packers (204) and the outer shroud of expanding SMP (208) with, e.g., a solution. The SMP packers (204) would isolate the zones with sliding sleeves (200) and the outer shroud of expanding SMP (208) would make a firm connection between the liner section (206) and the borehole wall, thus enabling perforation. Following this, fracing would begin in the furthest zone from the surface (107) (i.e., the fourth zone (506) at the bottom of the well). In this example, a sliding sleeve (200) would be opened in the fourth zone (506) using an RFID tag (402). An openhole perforation would then be performed in the exposed borehole section, and an RFID tag (402) would then trigger closure of the lowest isolation valve (202). Next, the third zone (504) up hole would be perforated as a plug & perf completion. For the plug & perf completion, a perforation gun would be lowered into the well and perforate both the liner section (206) and the SMP material between the liner and the borehole wall to create perforation fractures (410). Another RFID tag (402) would then be pumped into the well with fluid and trigger closure of the next isolation valve (202) towards the surface (107). This process would continue for each zone until no zones are left to fracture.

Figure 6:
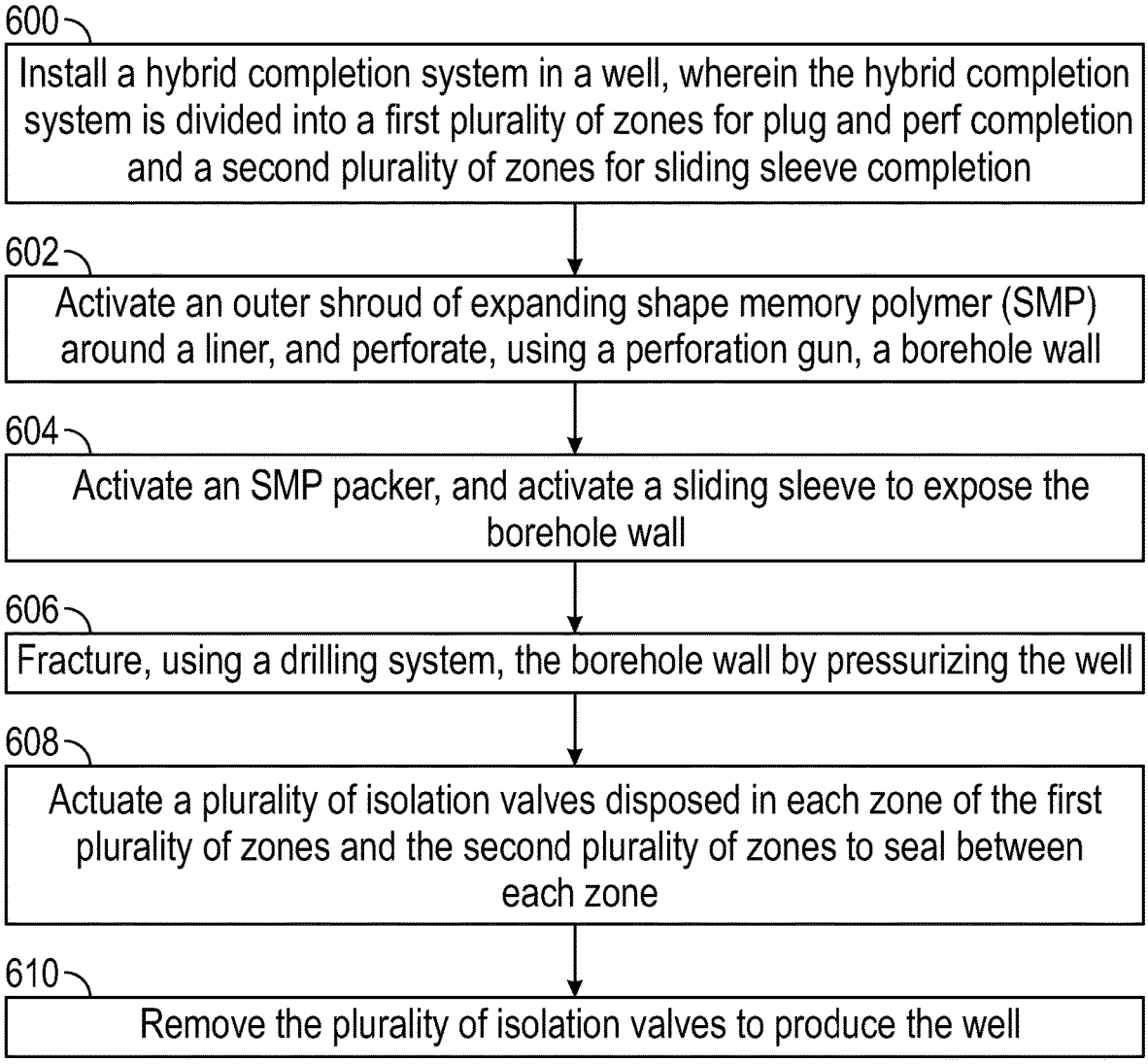
FIG. 6 shows a flowchart of a method in accordance with one or more embodiments.

FIG. 6 presents the workflow for the methods described above. Specifically, FIG. 6 shows a flowchart for operation of the hybrid completion system in accordance with one or more embodiments disclosed herein. The steps of FIG. 6 may be performed by components described in FIGS. 1-5.

In Step 600 a hybrid completion system is installed in a well. The deployment of the system requires multiple components that may be installed in single run. These components may be run on a standard liner (or casing (124)) into the openhole section by a rig as for any other completion design. That is, segments of special liner sections (206) are interconnected with segments of sliding sleeves (200) as they are both placed into the borehole (117). In this way, the hybrid completion system is divided into a first plurality of zones for plug & perf completion and a second plurality of zones for sliding sleeve completion. The number of plug & perf zones in the first plurality and the number of sliding sleeve zones in the second plurality may vary. Their order may also vary and the two types of completion designs may alternate from zone to zone.

In Step 602, once the hybrid completion is installed, the outer shrouds of SMP (208) associated with special liner sections (206) are then activated by a triggering agent to expand and create a seal between the outer diameter of the steel pipe and the inner diameter of the borehole (117) across the special liner section (206). Following the activation of the outer shrouds of expanding SMP (208), fracturing operations begin in a first zone at the toe-end of the borehole (117). If the first zone is a plug & perf zone, a perforation gun perforates the special liner section (206), the outer shroud of expanding SMP (208), and the borehole wall to create perforation fractures (410). After creating the perforation fractures (410), the zone is isolated using an isolation valve (202).

In Step 604, if this zone is a sliding sleeve zone, an SMP packer (204) may be activated to create a seal in the borehole (117) to isolate the zone. Further, a sliding sleeve (200) is activated to expose the borehole wall.

In one or more embodiments, the SMP material in both the outer shrouds of expanding SMP (208) and SMP packers (204) may be activated by a solution pumped into the well. Alternately, the SMP material is activated by an electric field, or another suitable means known to a person of ordinary skill in the art. The SMP material may be an epoxy resin or an alkali metal. However, any material known by a person of ordinary skill in the art may also be used as an SMP for the purposes of expanding and sealing between the liner and the borehole wall. A pipe section located with the sliding sleeve (200) may have compartments (209) used to contain the SMP material. However, any location in the hybrid design may also be used as a location for compartments (209) to contain the SMPs.

In Step 606, hydraulic fracturing equipment (here identified with the drilling system) may be used to pump a specially-designed proppant fracturing fluid, at pressures above that required to fracture a formation, down into the casing (124) and into the formation. In order to reach the formation, the casing (124) has to be perforated (in the case of a plug & perf section) or sleeves must opened (in the case of a sliding sleeve section) at specific target depths to create fractured channels in the rock formation. The perforations and sliding sleeves provide access points to the reservoir and allow the fracture fluids to enter the rock formations to create a network of fractures in the rock at high pressures.

The proppant fracturing fluid is typically composed of water, proppant (usually sand), and chemical additives. The chemical additives generally include a gelling agent (to increase the viscosity of the base fluid), a surfactant (for fluids compatibility), a cross-linker (to build complex polymer chains and increase fluid viscosity). The proppants are pumped into the formation to keep the fractures propped open and maintain the fracture conductivity. This provides a pathway for the gas to flow out of the formation and into the well and be recovered at the surface (107). In acid fracturing applications the acid fluid (organic or inorganic or mixtures of acid and emulsions) is also pumped at high pressures. The acid mixture comprises of water and acid with a gelling agent, a surfactant, and a cross-linker. Chemicals may also be added to the fluid for lubrication, to keep bacteria from forming, and to carry the sand in suspension. The fractures allow hydrocarbons in the hydrocarbon reservoir (104) to flow into the borehole (117) and subsequently be produced. The sand may remain in the fractures in the rock and prop them open when the pump pressure is relieved.

In Step 608, as part of fracing each zone, an isolation valve (202) is actuated between zones to seal a zone off from the rest of the well. More specifically, the isolation valves (202) are sequentially activated between each of the zones of both the first plurality of zones and the second plurality of zones to seal each zone off from the others. The isolation valves (202) may be actuated by RFID tags (402) pumped down into the well via a fluid. Similarly, sliding sleeves (200) may be activated by RFID tags (402) pumped into the wells via a fluid.

In Step 610, some time later when the well is in production, the isolation valves (202) used to seal off each zone are removed in order to produce hydrocarbons from the well. The isolation valves (202) may be removed by a drill bit (105). However, this is not the only way to remove an isolation valve (202). For example, the isolation valves (202) may be constructed to dissolve in place. Other methods to remove isolation valves (202) known to a person of ordinary skill in the art may also be used.

Figure 7:
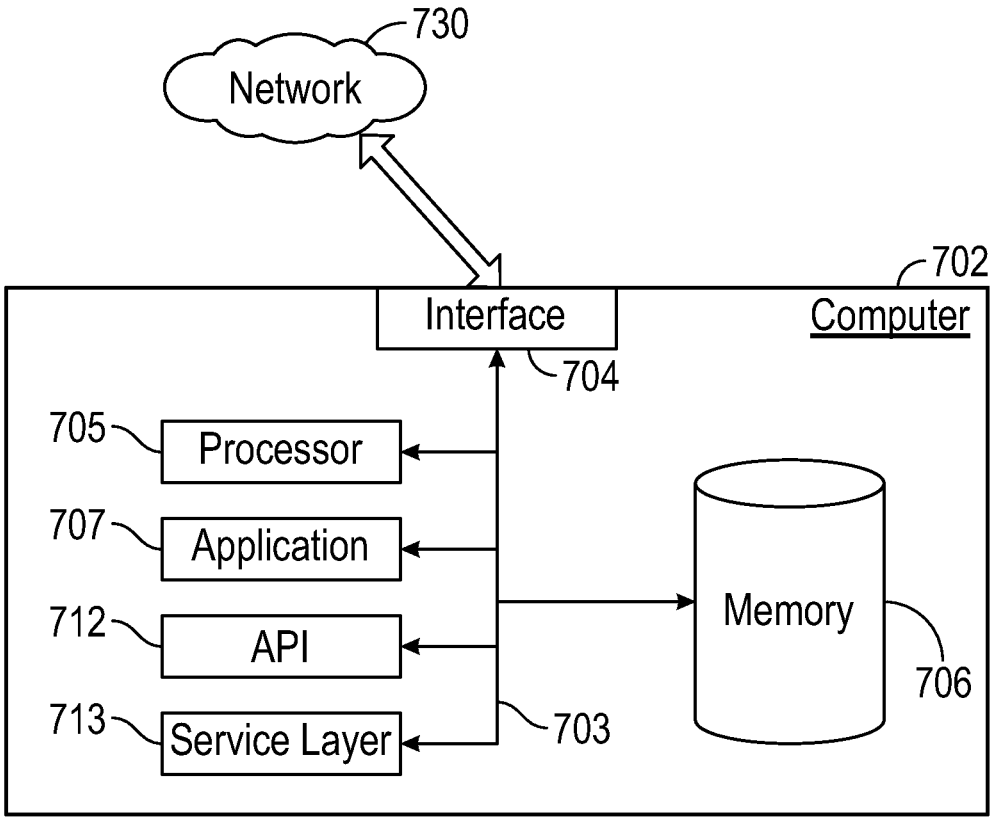
FIG. 7 shows a computer system in accordance with one or more embodiments.

A computer system (702) is necessary to operate the borehole planning system (150) and drilling system (100) to implement the hybrid completion design. FIG. 7 depicts a block diagram of a computer system (702) that may be used to provide computational functionalities associated with described algorithms, methods, functions, processes, flows, and procedures as described in this disclosure, according to one or more embodiments. The illustrated computer (702) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (702) may include an input device, such as a keypad, keyboard, touch screen, or other device that can accept user information, and an output device that conveys information associated with the operation of the computer (702), including digital data, visual, or audio information (or a combination of information), or a GUI.

The computer (702) can serve in a role as a client, network component, a server, a database or other persistency, or any other component (or a combination of roles) of a computer system for performing the subject matter described in the instant disclosure. The illustrated computer (702) is communicably coupled with a network (730). In some implementations, one or more components of the computer (702) may be configured to operate within environments, including cloud-computing-based, local, global, or other environment (or a combination of environments).

At a high level, the computer (702) is an electronic computing device operable to receive, transmit, process, store, or manage data and information associated with the described subject matter. According to some implementations, the computer (702) may also include or be communicably coupled with an application server, e-mail server, web server, caching server, streaming data server, business intelligence (BI) server, or other server (or a combination of servers).

The computer (702) can receive requests over network (730) from a client application (for example, executing on another computer (702)) and responding to the received requests by processing the said requests in an appropriate software application. In addition, requests may also be sent to the computer (702) from internal users (for example, from a command console or by other appropriate access method), external or third-parties, other automated applications, as well as any other appropriate entities, individuals, systems, or computers.

Each of the components of the computer (702) can communicate using a system bus (703). In some implementations, any or all of the components of the computer (702), both hardware or software (or a combination of hardware and software), may interface with each other or the interface (704) (or a combination of both) over the system bus (703) using an application programming interface (API) (712) or a service layer (713) (or a combination of the API (712) and service layer (713)). The API (712) may include specifications for routines, data structures, and object classes. The API (712) may be either computer-language independent or dependent and refer to a complete interface, a single function, or even a set of APIs. The service layer (713) provides software services to the computer (702) or other components (whether or not illustrated) that are communicably coupled to the computer (702). The functionality of the computer (702) may be accessible for all service consumers using this service layer. Software services, such as those provided by the service layer (713), provide reusable, defined business functionalities through a defined interface. For example, the interface may be software written in JAVA, C++, or other suitable language providing data in extensible markup language (XML) format or another suitable format. While illustrated as an integrated component of the computer (702), alternative implementations may illustrate the API (712) or the service layer (713) as stand-alone components in relation to other components of the computer (702) or other components (whether or not illustrated) that are communicably coupled to the computer (702). Moreover, any or all parts of the API (712) or the service layer (713) may be implemented as child or sub-modules of another software module, enterprise application, or hardware module without departing from the scope of this disclosure.

The computer (702) includes an interface (704). Although illustrated as a single interface (704) in FIG. 7, two or more interfaces (704) may be used according to particular needs, desires, or particular implementations of the computer (702). The interface (704) is used by the computer (702) for communicating with other systems in a distributed environment that are connected to the network (730). Generally, the interface (704) includes logic encoded in software or hardware (or a combination of software and hardware) and operable to communicate with the network (730). More specifically, the interface (704) may include software supporting one or more communication protocols associated with communications such that the network (730) or interface's hardware is operable to communicate physical signals within and outside of the illustrated computer (702).

The computer (702) includes at least one computer processor (705). Although illustrated as a single computer processor (705) in FIG. 7, two or more processors may be used according to particular needs, desires, or particular implementations of the computer (702). Generally, the computer processor (705) executes instructions and manipulates data to perform the operations of the computer (702) and any algorithms, methods, functions, processes, flows, and procedures as described in the instant disclosure.

The computer (702) also includes a memory (706) that holds data for the computer (702) or other components (or a combination of both) that can be connected to the network (730). For example, memory (706) can be a database storing data consistent with this disclosure. Although illustrated as a single memory (706) in FIG. 7, two or more memories may be used according to particular needs, desires, or particular implementations of the computer (702) and the described functionality. While memory (706) is illustrated as an integral component of the computer (702), in alternative implementations, memory (706) can be external to the computer (702).

The application (707) is an algorithmic software engine providing functionality according to particular needs, desires, or particular implementations of the computer (702), particularly with respect to functionality described in this disclosure. For example, application (707) can serve as one or more components, modules, applications, etc. Further, although illustrated as a single application (707), the application (707) may be implemented as multiple applications (707) on the computer (702). In addition, although illustrated as integral to the computer (702), in alternative implementations, the application (707) can be external to the computer (702).

There may be any number of computers (702) associated with, or external to, a computer system containing computer (702), wherein each computer (702) communicates over network (730). Further, the term "client," "user," and other appropriate terminology may be used interchangeably as appropriate without departing from the scope of this disclosure. Moreover, this disclosure contemplates that many users may use one computer (702), or that one user may use multiple computers (702).

Although only a few example embodiments have been described in detail above, those skilled in the art will readily appreciate that many modifications are possible in the example embodiments without materially departing from this invention.

Accordingly, all such modifications are intended to be included within the scope of this disclosure as defined in the following claims.

What is claimed is:

1. A method, comprising:

installing a hybrid completion system in a well, wherein the hybrid completion system is divided into a first plurality of zones for plug & perf completion and a second plurality of zones for sliding sleeve completion;

in each zone of the first plurality of zones for plug & perf completion:

activating an outer shroud of expanding shape memory polymer (SMP) around a liner, and perforating, using a perforation gun, a borehole wall;

in each zone of the second plurality of zones for sliding sleeve completion:

activating an SMP packer, and activating a sliding sleeve to expose the borehole wall, wherein a pipe section with the sliding sleeve has SMP compartments;

fracturing, using a drilling system, the borehole wall by pressurizing the well;

sealing, between each zone in the first and second plurality of zones, by actuating a plurality of isolation valves disposed in each zone of the first plurality of zones and each zone of the second plurality of zones; and removing the plurality of isolation valves to produce the well.

2. The method of claim 1, further comprising pumping a radio frequency identification (RFID) tag into the well.

3. The method of claim 2, wherein each of the plurality of isolation valves is activated by the RFID tag.

4. The method of claim 2, wherein the sliding sleeve is activated by the RFID tag.

5. The method of claim 1, wherein the plurality of isolation valves are removed by a drill bit.

6. The method of claim 1, wherein the SMP packer is activated by a solution.

7. The method of claim 1, wherein the outer shroud of the expanding SMP is activated by a solution.

8. The method of claim 1, wherein the SMP is an epoxy resin or an alkali metal.

9. A system, comprising:

a hybrid completion system, configured to be installed in a well, wherein the hybrid completion system is divided into a first plurality of zones for plug & perf completion and a second plurality of zones for sliding sleeve completion;

an outer shroud of expanding shape memory polymer (SMP), configured to be activated around a liner in each zone in the first plurality of zones for plug & perf completion;

a perforation gun, configured to perforate a borehole wall;

an SMP packer, configured to seal a borehole;

a sliding sleeve, configured to expose the borehole wall, wherein a pipe section with the sliding sleeve has SMP compartments;

a drilling system, configured to fracture the borehole wall by pressurizing the well;

a plurality of isolation valves, one in each zone of the first plurality of zones for plug & perf completion and the second plurality of zones for sliding sleeve completion, configured to seal each zone; and a drill bit, configured to remove the plurality of isolation valves and produce the well.

10. The system of claim 9, further comprising a radio frequency identification (RFID) tag configured to be pumped into the well.

11. The system of claim 10, wherein each of the plurality of isolation valves is activated by the RFID tag.

12. The system of claim 10, wherein the sliding sleeve is activated by the RFID tag.

13. The system of claim 9, wherein the plurality of isolation valves are removed by the drill bit.

14. The system of claim 9, wherein the SMP packer is activated by a solution.

15. The system of claim 9, wherein the outer shroud of expanding SMP is activated by a solution.

16. The system of claim 9, wherein the SMP is an epoxy resin or an alkali metal.

* * * * *